US006014941A

United States Patent [19]

Bent et al.

[11] Patent Number: 6,014,941

[45] **Date of Patent: *Jan. 18, 2000**

[54] TRAFFIC DELINEATOR

[75] Inventors: Bruce C. Bent; James A. Bent, both of Huntington Beach, Calif.

[73] Assignee: Bent Manufacturing Company, Huntington Beach, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/610,168

[22] Filed: Feb. 29, 1996

[51] Int. Cl.[7] ..... E01F 9/00

[52] U.S. Cl. ..... 116/63 R; 116/63 P; 404/6

[58] Field of Search ..... 116/63 P, 63 C, 116/63 R; 404/6, 9–14; 40/602, 612; D10/109, 111–114; 256/13.1, 65, 66, 1; 403/192, 263, 194, 201; 182/228.4

[56] References Cited

U.S. PATENT DOCUMENTS

| | | | |
|---|---|---|---|
| D. 60,293 | 1/1922 | Meden . | |
| 196,889 | 11/1877 | Gillham | 256/66 |
| D. 235,744 | 7/1975 | England . | |
| D. 243,073 | 1/1977 | Kulp et al. . | |
| D. 243,074 | 1/1977 | Kulp et al. . | |
| D. 243,075 | 1/1977 | Kulp et al. . | |
| D. 272,809 | 2/1984 | Bent et al. . | |
| D. 276,510 | 11/1984 | Bent et al. . | |
| D. 279,275 | 6/1985 | Cory . | |
| D. 310,642 | 9/1990 | Kulp . | |
| D. 320,172 | 9/1991 | Thurston . | |
| D. 386,705 | 11/1997 | Morgan | D10/113 |
| 2,448,413 | 8/1948 | Borghesi . | |
| 2,456,685 | 12/1948 | Delmotte . | |
| 2,483,734 | 10/1949 | Neal . | |
| 2,564,145 | 8/1951 | Beall et al. . | |
| 2,628,587 | 2/1953 | Peters et al. . | |
| 2,649,803 | 8/1953 | Andre . | |
| 2,762,327 | 9/1956 | Weig . | |
| 2,762,328 | 9/1956 | Weig . | |
| 2,808,803 | 10/1957 | Weig . | |
| 2,817,308 | 12/1957 | Scanlon . | |
| 2,843,347 | 7/1958 | King . | |
| 2,957,444 | 10/1960 | Boettler . | |
| 2,977,864 | 4/1961 | Pullar . | |
| 3,099,244 | 7/1963 | Knapp . | |
| 3,119,588 | 1/1964 | Keats . | |
| 3,231,994 | 2/1966 | Cyrus . | |

(List continued on next page.)

FOREIGN PATENT DOCUMENTS

| | | |
|---|---|---|
| 216329 | 6/1956 | Australia . |
| 2 580 050 | 10/1986 | France . |
| 2 233 994 | 2/1974 | Germany . |
| 665785 | 1/1952 | United Kingdom . |
| 1058881 | 2/1967 | United Kingdom . |
| 1 301 084 | 12/1972 | United Kingdom . |
| 2 077 332 | 5/1981 | United Kingdom . |
| 2 090 313 | 12/1981 | United Kingdom . |
| 2 081 348 | 2/1982 | United Kingdom . |
| 2 101 180 | 1/1983 | United Kingdom . |
| 2 122 239 | 5/1983 | United Kingdom . |
| 2 156 409 | 3/1984 | United Kingdom . |
| 2 182 701 | 10/1986 | United Kingdom . |

OTHER PUBLICATIONS

1991 Safetycade.
Oct. 17, 1991 Flasher Flare.
Oct. 17, 1991 Traffic Safety Service.
1992 Best Barricade.

*Primary Examiner*—Andrew Hirshfeld
*Attorney, Agent, or Firm*—J. Harrison Colter

[57] ABSTRACT

A traffic delineator includes a cylinder and a base. The base has a hole therethrough to permit the cylinder to be inserted into the base and the base then holds the cylinder down. A grip is formed in the center section of the cylinder to increase ease of carrying the delineator. The cylinder may also include a handle and means for affixing traffic warning lights and flags. The base may include means for holding removable ballast. The cylinder is formed by blow molding.

12 Claims, 10 Drawing Sheets

U.S. PATENT DOCUMENTS 3,380,428 4/1968 Abrams .
3,451,368 6/1969 Keats .
3,471,114 10/1969 Ball .
3,499,413 3/1970 Heard .
3,520,235 7/1970 Palazzolo .
3,563,445 2/1971 Fairport .
3,618,556 11/1971 Dittrich .
3,619,443 11/1971 Feldman .
3,664,085 5/1972 Rosseau et al. .
3,664,618 5/1972 Krueger ..... 116/63 C
3,675,811 7/1972 Artz .
3,701,456 10/1972 Alroy .
3,738,309 6/1973 Nichol .
3,751,852 8/1973 Schrepper .
3,794,090 2/1974 Commisso .
3,809,007 5/1974 Brown .
3,822,668 7/1974 Schradieck .
3,825,114 7/1974 Johnson et al. .
3,846,935 11/1974 Wagner .
3,913,518 10/1975 Kaplan ..... 116/63 P
3,916,816 11/1975 Fitch .
3,949,701 4/1976 Teixeira .
3,950,208 4/1976 Pavuk et al. .
3,952,690 4/1976 Rizzo et al. .
4,006,702 2/1977 St. Cyr .
4,007,919 2/1977 Totten .
4,026,086 5/1977 Langley .
4,040,759 8/1977 Skalle .
4,053,100 10/1977 Baptist .
4,054,207 10/1977 Lazure et al. .
4,071,224 1/1978 Gilbert .
4,083,033 4/1978 Kulp et al. .
4,102,453 7/1978 Carroll et al. .
4,120,398 10/1978 Braddon et al. .
4,134,533 1/1979 Heavner .
4,145,044 3/1979 Wilson et al. .
4,175,661 11/1979 Barnes .
4,184,604 1/1980 Amberg et al. .
4,197,808 4/1980 Kinninger .
4,201,975 5/1980 Marcus .
4,239,137 12/1980 Arcoutte .
4,256,050 3/1981 Barnard .
4,289,419 9/1981 Young et al. .
4,291,830 9/1981 Sorensen .
4,298,186 11/1981 Glass .
4,303,349 12/1981 Upton .
4,312,600 1/1982 Schaaf et al. .
4,317,617 3/1982 Charlton .
4,329,800 5/1982 Shuman .
4,334,616 6/1982 Wilson .
4,348,133 9/1982 Trent et al. .
4,349,147 9/1982 Jensen .
4,418,863 12/1983 Kimbrell, Sr. .
4,441,600 4/1984 Caray .
4,441,615 4/1984 Goodrich .
4,466,376 8/1984 Wells .
4,475,101 10/1984 Kulp et al. .
4,516,109 5/1985 Thurston .
4,520,928 6/1985 Wilson .
4,570,798 2/1986 Wilson .
4,596,489 6/1986 Mariol et al. .
4,611,949 9/1986 Schmanski .
4,624,210 11/1986 Glass .
4,674,431 6/1987 Cory ..... 116/63 P
4,688,766 8/1987 Zucker .
4,710,053 12/1987 Kulp et al. .
4,772,869 9/1988 Grammas et al. ..... 116/63 P
4,782,783 11/1988 Kulp et al. .
4,792,258 12/1988 Goff .
4,852,511 8/1989 Look et al. .
4,859,983 8/1989 Kulp et al. .
4,973,190 11/1990 Erwin et al. .
5,003,912 4/1991 Thurston .
5,009,541 4/1991 Thurston .
5,026,204 6/1991 Kulp et al. .
5,036,791 8/1991 Thurston ..... 116/63 P
5,046,885 9/1991 Thurston .
5,103,616 4/1992 Nordberg .
5,161,783 11/1992 German ..... 256/65
5,165,818 11/1992 Newhart .
5,168,827 12/1992 Junker ..... 116/63 C
5,199,813 4/1993 Nagler .
5,199,814 4/1993 Clark et al. .
5,201,599 4/1993 Kulp et al. ..... 116/63 P
5,234,280 8/1993 Cowan .
5,387,049 2/1995 Duckett .
5,451,118 9/1995 Wilkins et al. .
5,458,434 10/1995 Bent et al. .
5,540,007 7/1996 Kulp et al. .
5,546,984 8/1996 Kulp et al. .
5,560,732 10/1996 Kulp et al. ..... 116/63 P
5,577,824 11/1996 Wright ..... 116/63 C 40
36
32
30
26
24
26
24
12
10
48
54
52
50
14
16
46
18

TRAFFIC DELINEATOR

BACKGROUND OF THE INVENTION

This invention relates generally to traffic delineators, and more particularly to a traffic delineator comprising a blow-molded plastic cylinder and base that includes a centrally located grip.

The development of plastic traffic delineators, such as plastic cylinders, cones and barrels, for directing and channeling traffic flows has significantly increased the safety of automotive transportation. If a wood or metal delineator is struck by an automobile, the occupants may be seriously injured and the automobile seriously damaged. If a car being channeled by a line of plastic cylindrical delineators strikes one of the plastic cylinders, the lightweight, collapsible delineator causes little damage to the vehicle, which reduces the risk of injury to the vehicle occupants. Plastic cylinders are also sufficiently resilient to withstand numerous hits from vehicles and not show significant wear.

Plastic cylindrical traffic delineators have many advantages, including relative ease of manufacturing, light weight, and easy storage because the cylinders have a relatively narrow diameter and thus do not require significant space. The cylindrical delineators may be made of numerous colors, but a bright "florescent" orange has become common. Such coloration makes the cylinders more easily seen, day or night and in good or bad weather, than other colors.

For ease of manufacture and use, cylindrical delineators are often made in two pieces, an upper cylinder over which a drop down base is placed. The cylinder is usually a light-weight structure having a thin, plastic wall. The drop down base may be made of lightweight plastic, but is often made of heavy rubber. Sandbags or other ballasting materials may be used to increase the weight of the base and cylinder combination.

Recently, manufacturers have included handles on the top of the cylindrical delineators to make it easier to move the delineators. One such handle is that on the cylindrical delineator being sold by Bent Manufacturing company of Huntington Beach, Calif. That handle has a modified "T" shape, with the upper surface of the handle having an arcuate curvature to fit into human hands. Another cylindrical delineator having a handle on top is depicted in U.S. Pat. No. 5,036,791 to Thurston. That patent depicts two handles, one being of a generally "T" shape and the other having an inverted "U" shape. Yet another cylindrical delineator handle is that on the delineator being sold by Traffix Devices, Inc. of San Clemente, Calif. That handle is merely a reduction in the diameter of the cylinder, and then an abrupt enlargement of the diameter on the very top end of the cylinder, to form what may be termed as a "baseball bat" handle.

It is often necessary or useful to move the delineator. The cylinder and base delineator is usually relatively heavy, so that wind or minor impacts with vehicles do not knock the delineator over, and is also cumbersome, due to the dimensions of the cylinder and base. Thus, re-positioning a cylinder and base a short distance may require workers to lift the heavy, cumbersome cylinder and base combination.

Although the handle helps significantly, the placement of the handle causes problems. Existing handles formed on the top end of the cylinder may be useful for grabbing a delineator from the bed of a truck and moving it a short distance, or even up unto the truck. However, the cylinders may be 42 inches or more in height, and so a worker on the ground next to a delineator often has a difficult time carrying the delineator. Pulling the cylinder off the base can be time-consuming, and so if the cylinder and base are only to be moved a short distance, the worker does not usually want to pull the cylinder off the base. As a result, workers have been required to drag the delineator using the top handle, get assistance from another person, risk injury, or take the time to uncouple the base and cylinder just to move the delineator a short distance.

SUMMARY OF THE INVENTION

According to the present invention, a base and cylinder traffic delineator is provided that overcomes these and other drawbacks of the prior delineators. A delineator made according to the present invention is inexpensive to manufacture and has parts that are interchangeable with existing cylinder and base delineators. The base is preferably compression molded from heavy rubber. The cylinder is preferably blow molded from light weight plastic, and may be made in a variety of shapes and from a variety of materials.

The cylinder includes a generally centrally disposed grip to facilitate repositioning of the delineator. The grip is preferably formed into the cylinder at a location that will be relatively close to the center of gravity of the cylinder and base combination, so that when carried by the grip the delineator is generally balanced. This reduces the awkwardness of moving the delineator, and thus reduces the risk of injury when the delineator is moved.

The grip may take various shapes, to provide flexibility in design. For instance, a cavity may be formed into the cylinder for grasping, or the diameter of the cylinder may be reduced to permit a hand to grasp the cylinder. In each case, the grip does not interfere with placing the base over the cylinder, or with the visibility of the cylinder when in use. In fact, some designs for the grip may provide additional strength to the cylinder.

The top of the cylinder made in accordance with the present invention may also include a handle to facilitate grasping the cylinder. Thus, the present invention retains all the advantages of prior delineators while providing additional advantages.

BRIEF DESCRIPTION OF THE DRAWINGS

Other features and advantages of the present invention will be apparent from the following Detailed Description taken in conjunction with the accompanying Drawings, in which.

DETAILED DESCRIPTION

Figure 1:
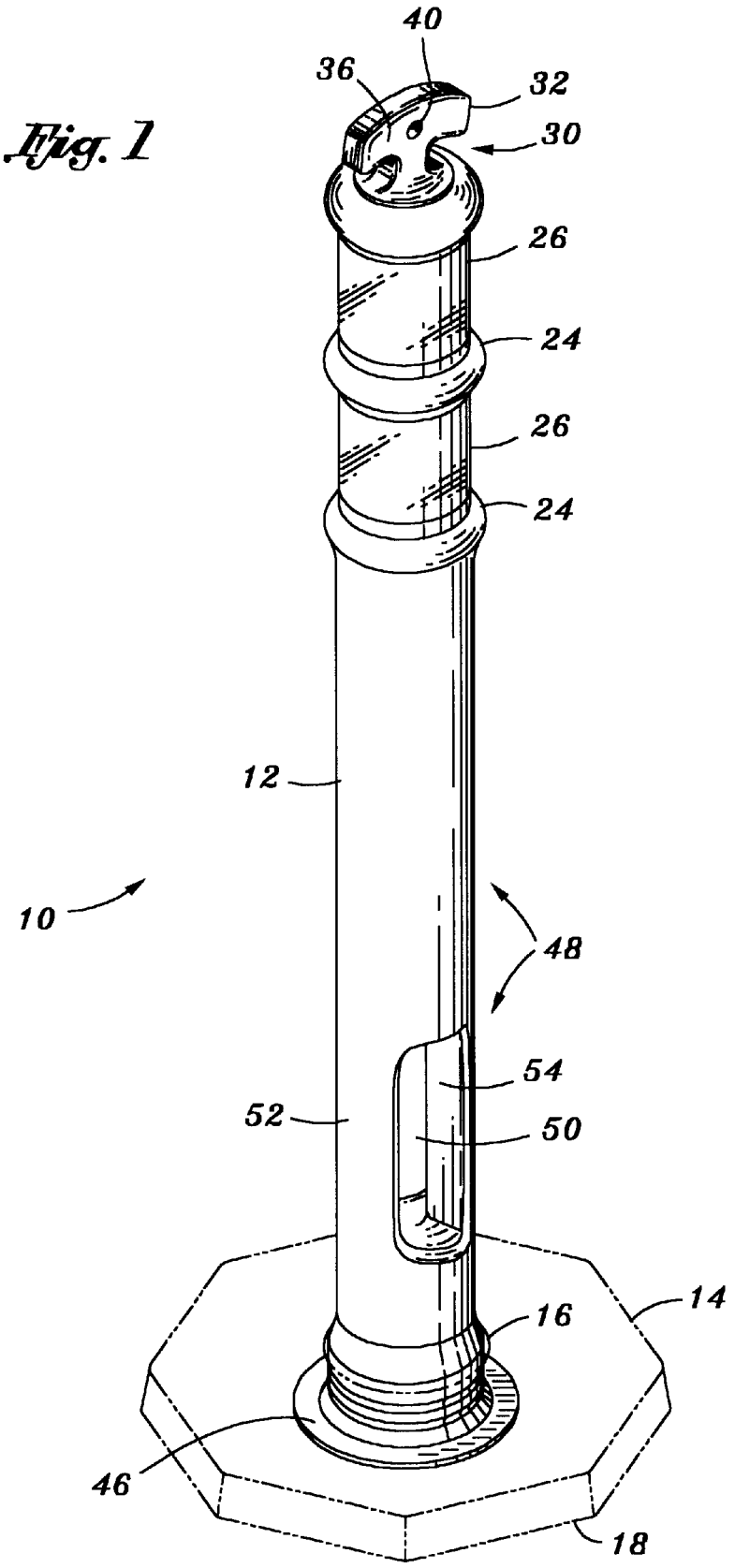
FIG. 1 is a perspective view of a traffic delineator cylinder according to one embodiment of the present invention.
Figure 2:
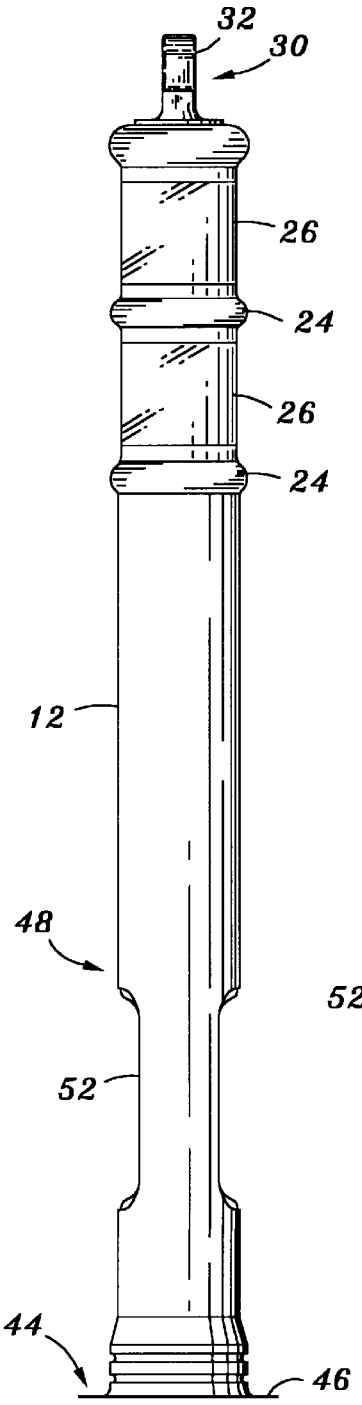
FIG. 2 is a first side view of the cylinder of FIG. 1.
Figure 3:
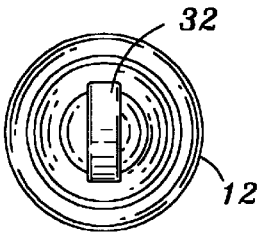
FIG. 3 is a top view of the cylinder of FIG. 1.

As shown in the drawings, the present invention is embodied in a traffic delineator 10 comprised of a cylinder 12 removably mounted inside a base 14. The cylinder 12 is a unitary piece, preferably made of a lightweight, blow molded plastic. The base 14 is a unitary piece having a circular opening 16 formed perpendicularly through the center of the base 14 to receive the cylinder 12.

The base 14 may be any of those known in the art. The base 14 is relatively heavy and also low to the ground. The base has a bottom surface 18 that is adapted to rest on the road surface. The top of the base is flat for ease of stacking. In some embodiments, the base 14 is made of molded rubber, recycled automobile tires, or another high density molded material. In other embodiments, the base 14 is made of light weight plastic, and may be designed to be provided with ballast.

Typically, the base 14 is octagonal and the bottom surface 18 is generally planar, although the base may have cavities formed into the bottom surface. The base could even be a used automobile tire, which of course already has a center circular opening. The base may also include wheels or a drag plate to assist workers in moving the base without seriously damaging the base and without causing injury to the worker.

The cylinder 12 is preferably formed by blow molding and subsequent trimming. The cylinder 12 may be made of many shapes and colors, including those most common in the current traffic delineation industry, and preferably is interchangeable with existing cylinders and may be used with existing bases. The cylinder may be made of any of the materials known in the art, and usually includes pigments for the desired color, ultraviolet light inhibitors, stabilizers and fillers.

In the first embodiment of the present invention depicted in FIGS. 1–6, the cylinder 12 comprises a hollow, generally cylindrical body having an open bottom section 20 that leads into a central cavity 22 formed by the cylinder body. Making the cylinder hollow reduces the weight of the cylinder and significantly reduces the amount of material needed for the cylinder. The cylinder 12 may include radial protrusions 24 to segregate portions of the cylinder. These protrusions may provide additional strength to the cylinder, but often the intent is merely an aesthetic one, that is, to make the cylinder more visually pleasing. Often, the radial protrusions form the boundary between smooth sections 26 on which retroreflective sheeting may be affixed to the cylinder.

The upper end 30 of the cylinder 12 may be formed into a handle 32. In the various FIGURES, different handles are shown on the upper end 30 of the cylinder 12. The handle 32 is preferably hollow so that when blow molded, the hollow handle cools quickly.

The handle 32 shown in the embodiment of the invention depicted in FIGS. 1–6 has a modified "T" shape. Fingers grasp the handle 32 at undercut portions 34. The crossing surface 36 on top of the handle 32 is preferably formed with a convex arc that facilitates holding the handle 32 in the palm of the hand.

Figure 4:
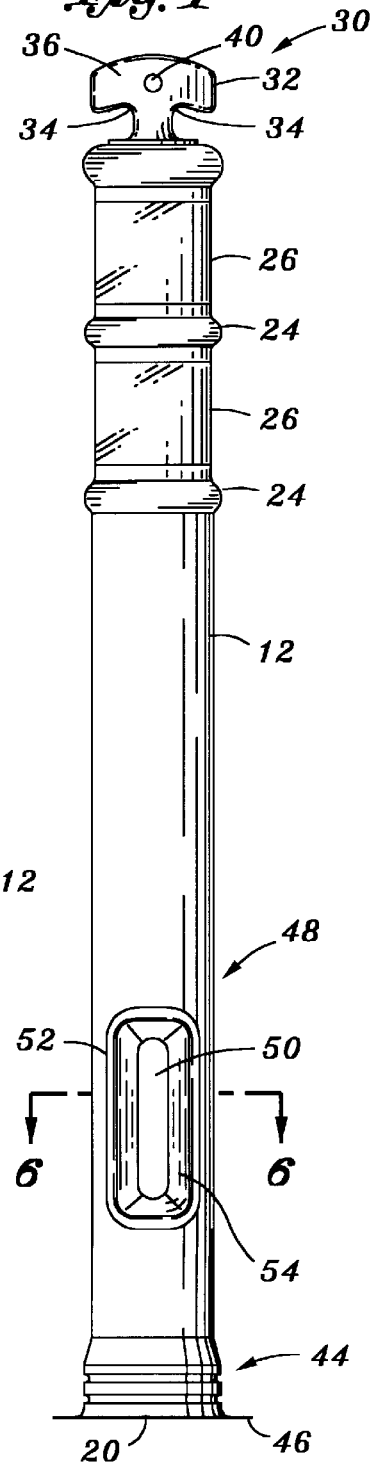
FIG. 4 is a second side view of the cylinder of FIG. 1.
Figure 6:
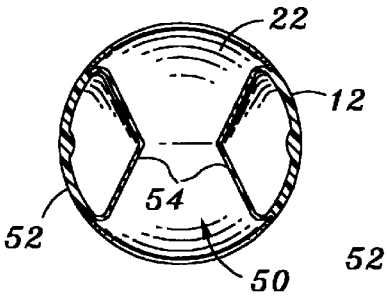
FIG. 6 is a cross-sectional view of the cylinder shown in FIG. 1 taken along the line 6—6 of FIG. 4.
Figure 5:
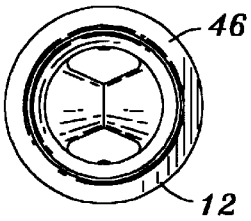
FIG. 5 is a bottom view of the cylinder of FIG. 1.

As shown in FIGS. 1 and 4, a hole 40 may be formed into the upper end 30 or the handle 32 of the cylinder 12. Such a hole 40 is useful for mounting a light, sign, or other traffic safety device to the cylinder 12. The hole 40 may be compression molded into the upper end 30, or may be cut out of the upper end 30 after molding, preferably by incorporating a divot into the mold where the hole 40 is to be placed. A bore for accepting a flag pole may also be included on the upper end 30 of the cylinder, in which case a detent may be formed into the side wall of the upper end 30 for supporting the flag pole when inserted into the bore.

The lower end 44 of the cylinder 12 flares into an outwardly extending flange 46. This flange has a radial diameter greater that the diameter of the circular opening 16 in the base 14. When the base 14 is dropped down over the cylinder 12, the flange 46 engages the bottom surface 18 of the base to support the cylinder in an upright position in the base. Thus, the cylinder 12 stays upright when the traffic delineator 10 is placed on the road surface.

The cylinder 12 includes a central section 48 between the upper end 30 and the lower end 44. In the embodiment shown in FIGS. 1–6, a channel 50 through the diameter of the cylinder 12 forms a grip 52. This grip 52 may be used to carry the cylinder 12 or the complete delineator 10 including the base 14. The grip is generally formed near the center of gravity of the delineator 10 so that a worker carrying the delineator by the grip 52 does not have significant balance problems. The additional walls 54 forming the grip 52 increase the strength of the cylinder 12, and the channel 50 permits communication through the cylinder. As a result, the cylinders of this first embodiment of the present invention may be strung together by rope passed through the channel, if desired.

Figure 7:
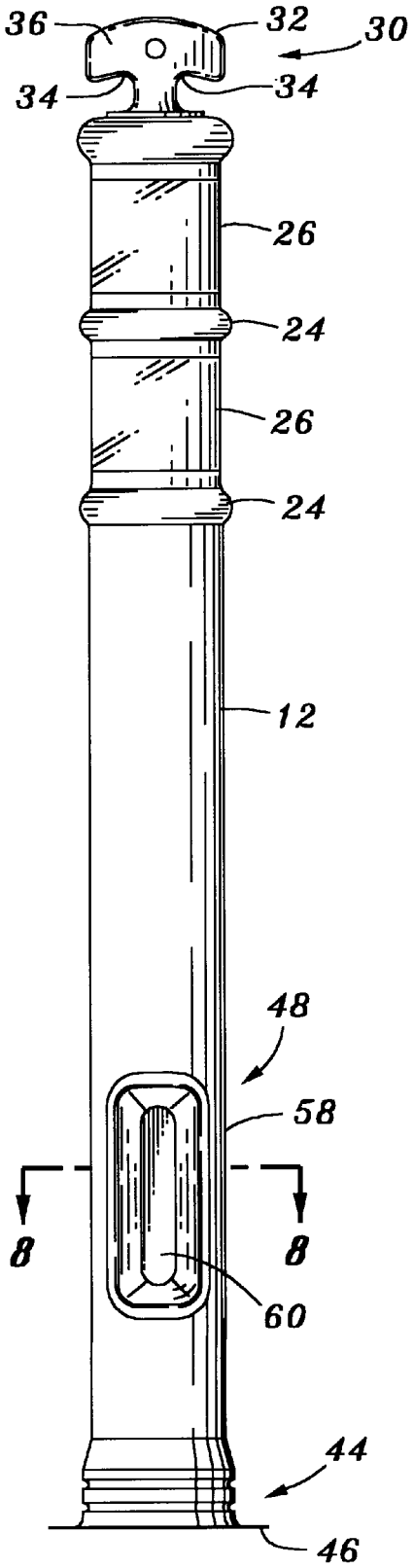
FIG. 7 is a side view of a traffic delineator cylinder according to a second embodiment of the present invention.
Figure 8:
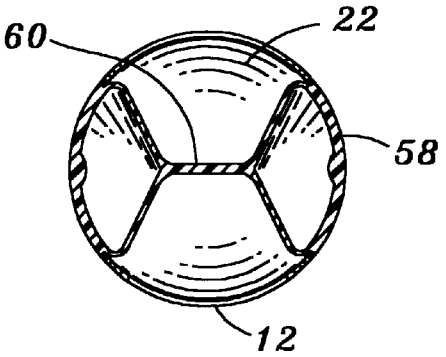
FIG. 8 is a cross-sectional view of the cylinder shown in FIG. 7 taken along the line 8—8 of FIG. 7.
Figure 9:
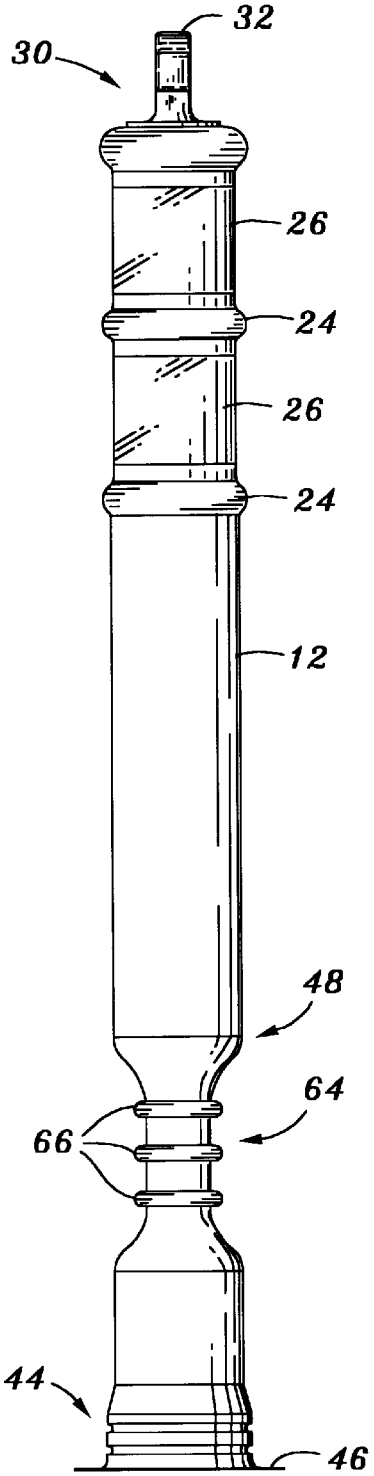
FIG. 9 is a first side view of a traffic delineator cylinder according to a third embodiment of the present invention.
Figure 10:
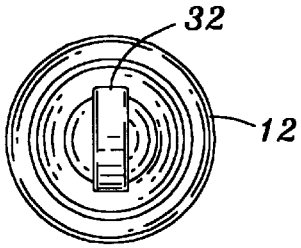
FIG. 10 is a top view of the cylinder of FIG. 9.
Figure 11:
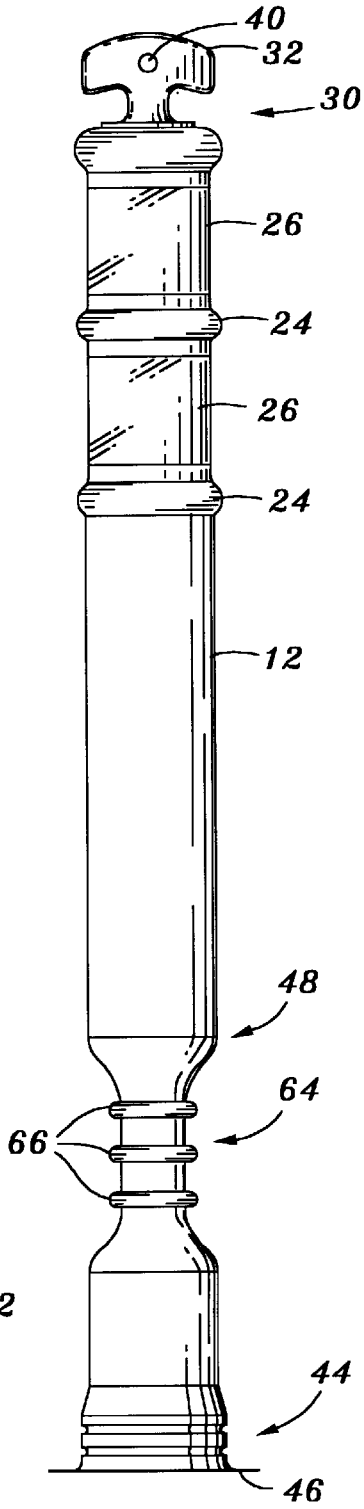
FIG. 11 is a second side view of the cylinder of FIG. 9.
Figure 12:
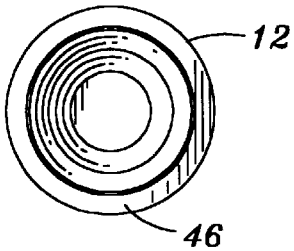
FIG. 12 is a bottom view of the cylinder of FIG. 9.
Figure 13:
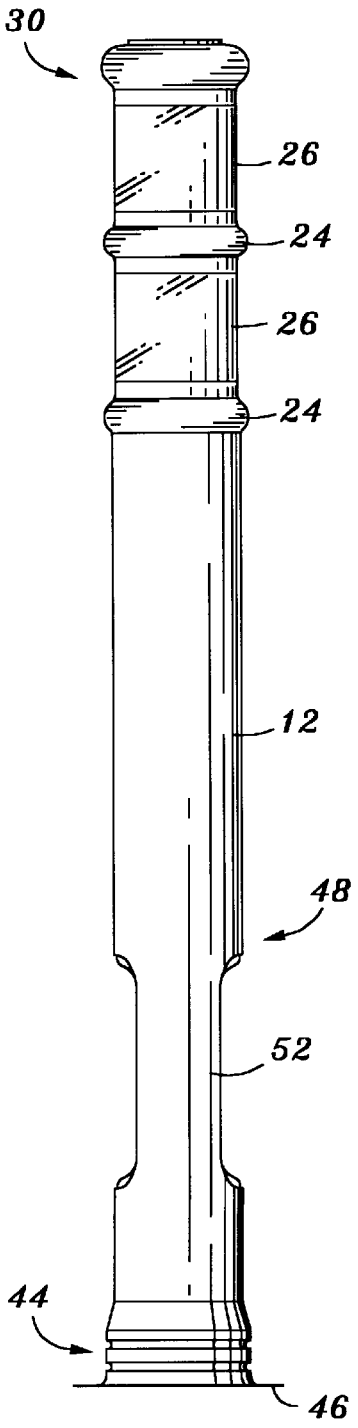
FIG. 13 is a first side view of a traffic delineator cylinder according to a fourth embodiment of the present invention.
Figure 14:
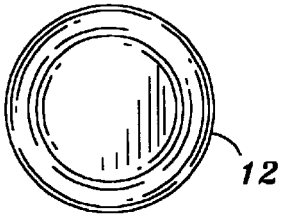
FIG. 14 is a top view of the cylinder of FIG. 13.
Figure 15:
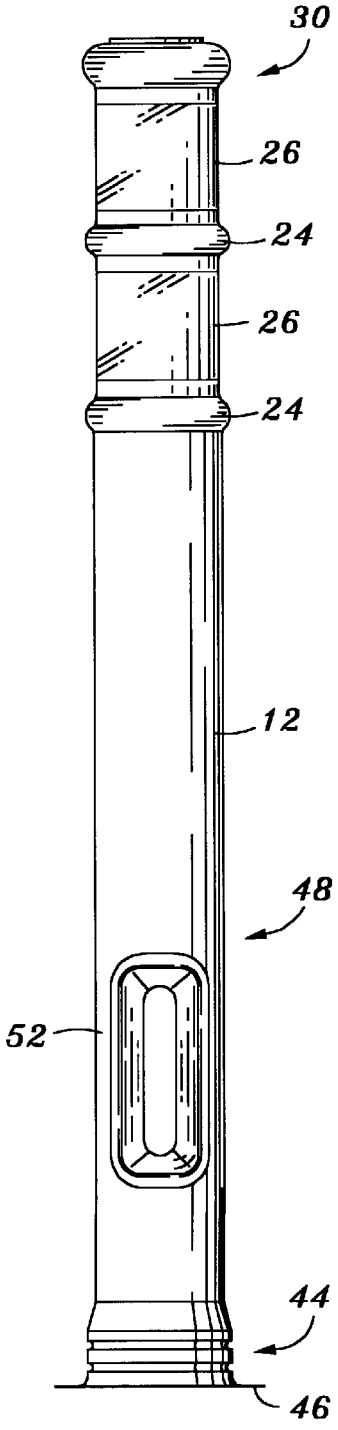
FIG. 15 is a second side view of the cylinder of FIG. 13.
Figure 16:
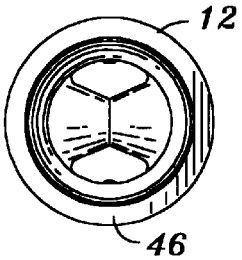
FIG. 16 is a bottom view of the cylinder of FIG. 13.

In the second embodiment of the present invention depicted in FIGS. 7 and 8, the cylinder 12 is generally the same as in the first embodiment. However, the second embodiment has a slightly different grip 58. In this embodiment, the grip 58 is not formed as a channel through the diameter of the cylinder 12. Rather, the grip 58 is formed by a pair of opposing cavities molded in the side wall of the center section 48 of the cylinder. As a result, this grip 58 includes a center wall 60 that provides additional structural strength to the cylinder.

A third embodiment of the invention is depicted in FIGS. 9–12. According to this third embodiment, the upper end 30 and lower end 44 of the cylinder 12 are similar to the first embodiment. However, according to the third embodiment, a grip 64 is formed as a reduced diameter of the cylinder 12. This reduced diameter permits the fingers and thumb of a human hand to grasp the grip 64. Protruding rings 66 are formed into the grip 64 to provide increased strength, reduced slippage, and better aesthetics.

According to a fourth embodiment of the present invention, depicted in FIGS. 13–16, the cylinder 12 does not include the handle 32 on the upper end 30. Forming a handle in the cylinder 12 is typically more difficult, and thus more time-consuming and expensive, than not forming a handle, and thus certain applications do not justify a handle. This embodiment includes a grip 52 similar to the grip of the first embodiment.

In this fourth embodiment, the upper end 30 may be formed into a dome shape. The rounding top of a dome helps distribute the plastic when blow molding the cylinder. As a result, the upper end 30 has better distribution of plastic throughout, and the corner connecting the upper end 30 to the side wall of the cylinder 12 even has additional plastic to provide added strength. Radial ribs may be formed in the dome to further increase the strength of the cylinder upper end.

Figure 17:
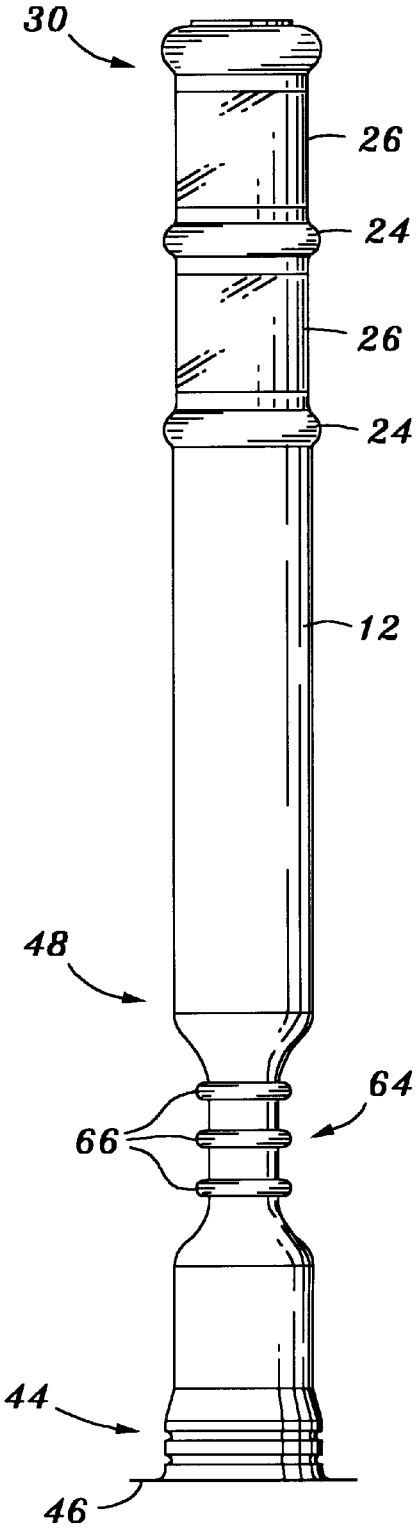
FIG. 17 is a side view of a traffic delineator cylinder according to a fifth embodiment of the present invention.
Figure 18:
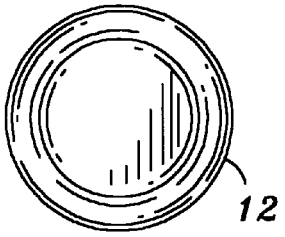
FIG. 18 is a top view of the cylinder of FIG. 17.
Figure 19:
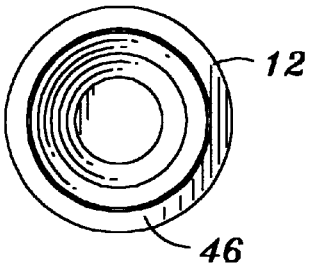
FIG. 19 is a bottom view of the cylinder of FIG. 17.
Figure 20:
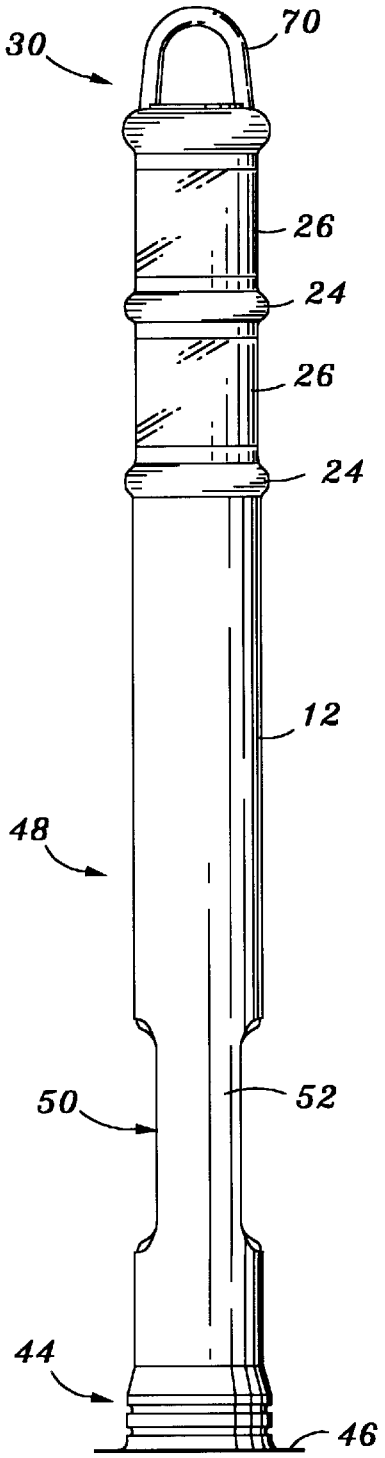
FIG. 20 is a first side view of a traffic delineator cylinder according to a sixth embodiment of the present invention.
Figure 21:
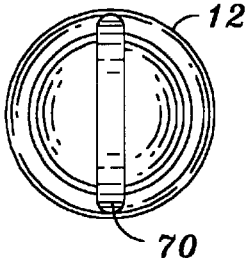
FIG. 21 is a top view of the cylinder of FIG. 20.
Figure 22:
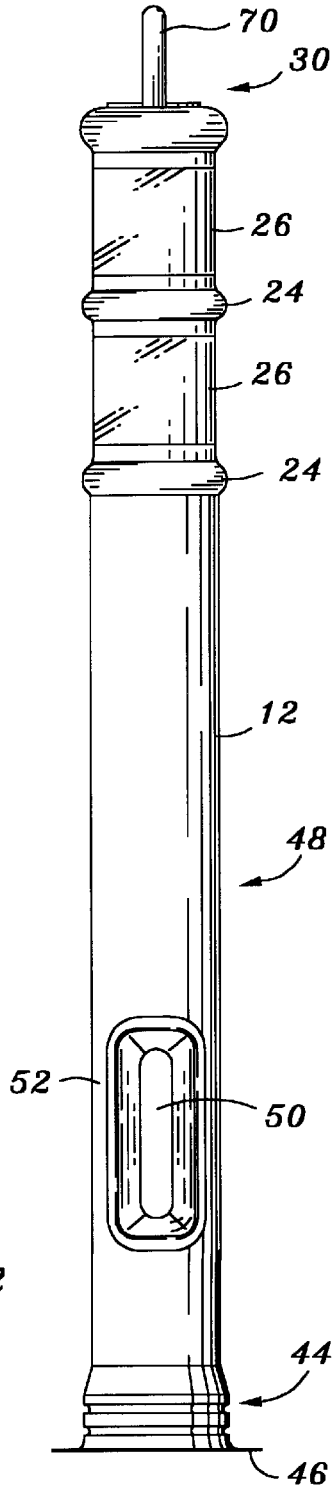
FIG. 22 is a second side view of the cylinder of FIG. 20.
Figure 23:
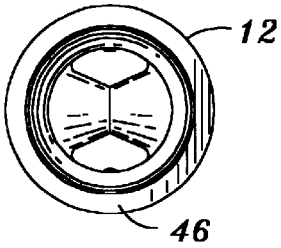
FIG. 23 is a bottom view of the cylinder of FIG. 20.
Figure 24:
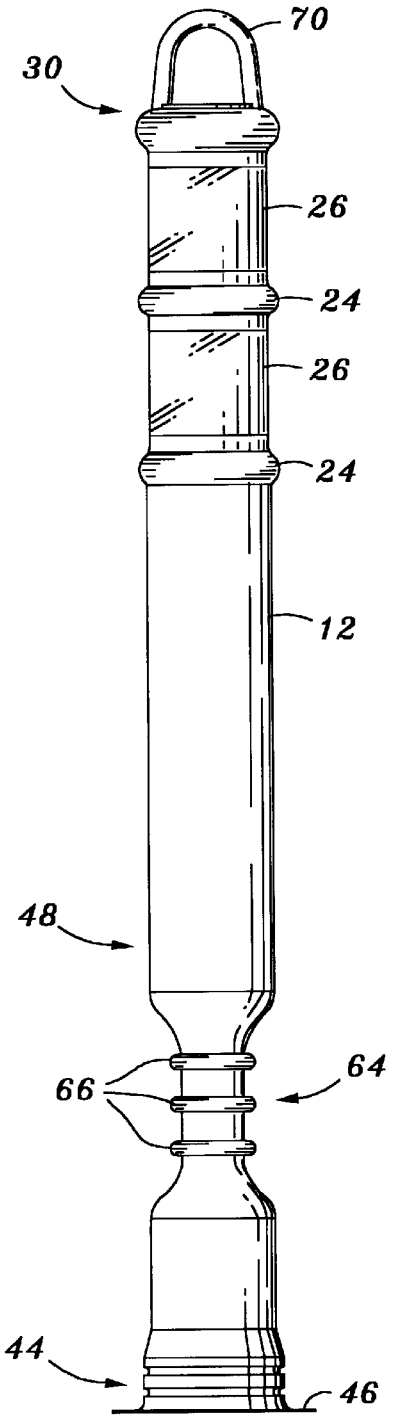
FIG. 24 is a first side view of a traffic delineator cylinder according to a seventh embodiment of the present invention.
Figure 25:
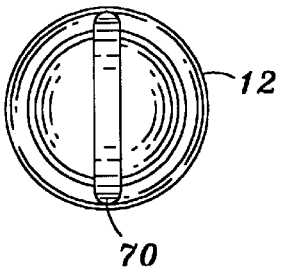
FIG. 25 is a top view of the cylinder of FIG. 24.
Figure 26:
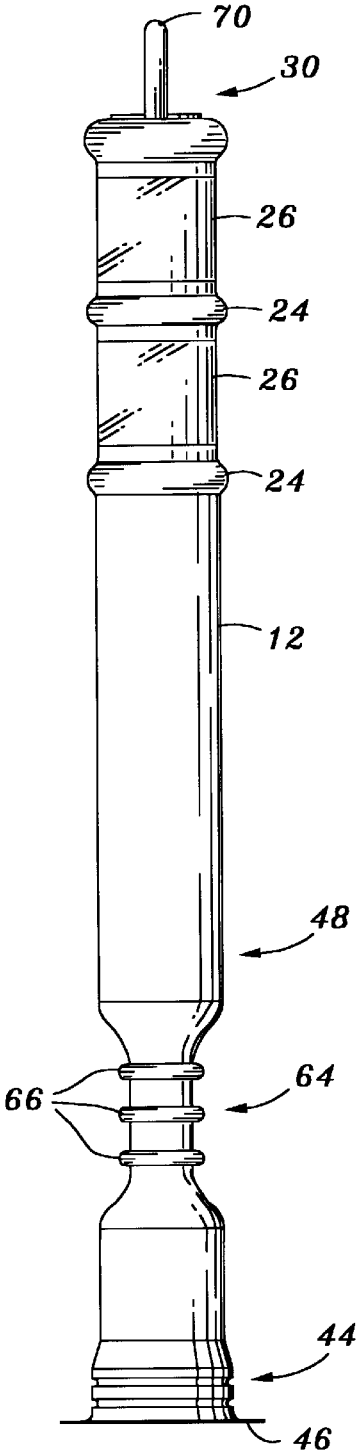
FIG. 26 is a second side view of the cylinder of FIG. 24.
Figure 27:
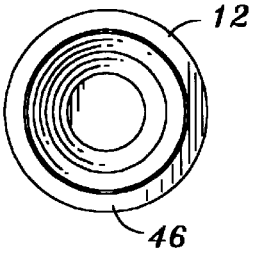
FIG. 27 is a bottom view of the cylinder of FIG. 24.
Figure 28:
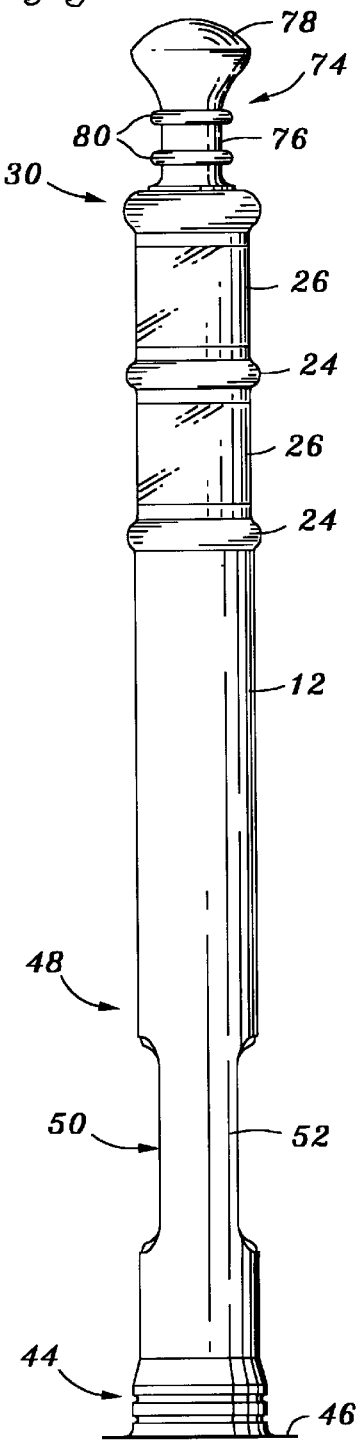
FIG. 28 is a first side view of a traffic delineator cylinder according to an eighth embodiment of the present invention.
Figure 29:
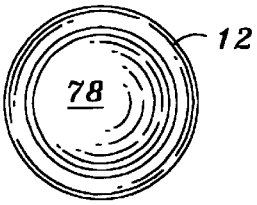
FIG. 29 is a top view of the cylinder of FIG. 28.
Figure 30:
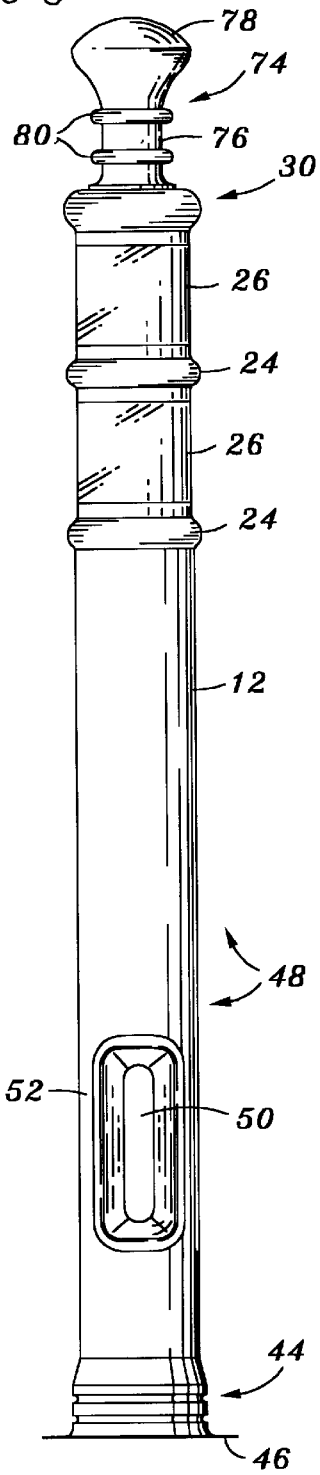
FIG. 30 is a second side view of the cylinder of FIG. 28.
Figure 31:
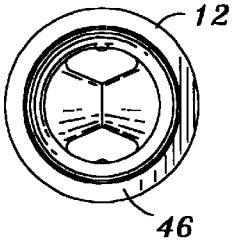
FIG. 31 is a bottom view of the cylinder of FIG. 28.
Figure 32:
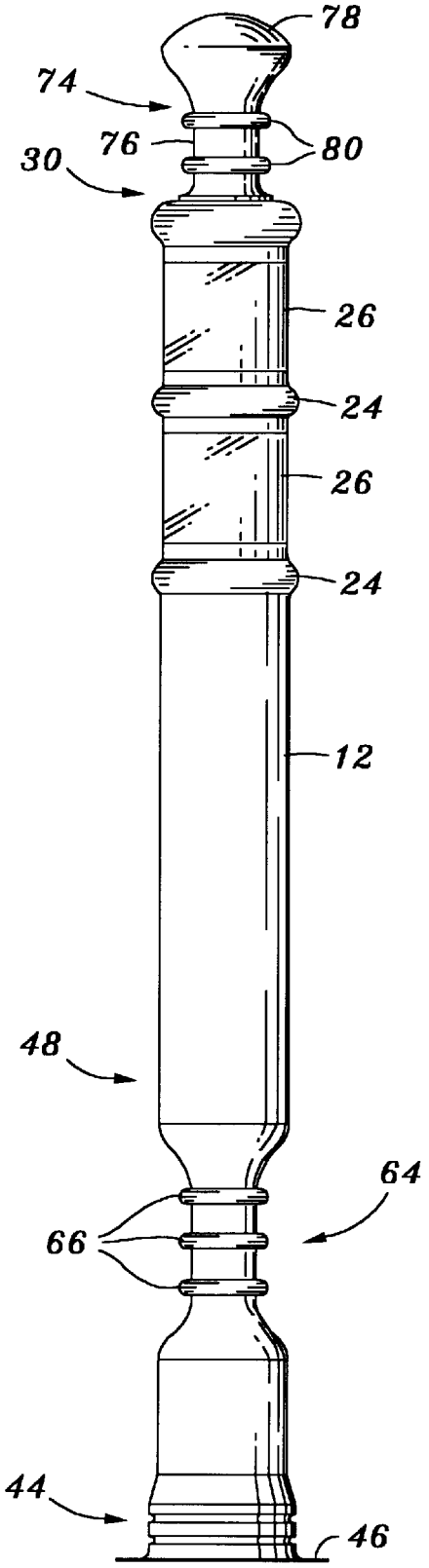
FIG. 32 is a side view of a traffic delineator cylinder according to a ninth embodiment of the present invention.
Figure 33:
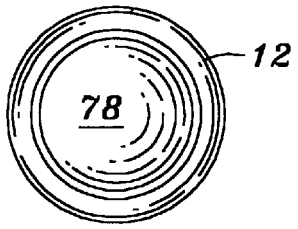
FIG. 33 is a top view of the cylinder of FIG. 32.
Figure 34:
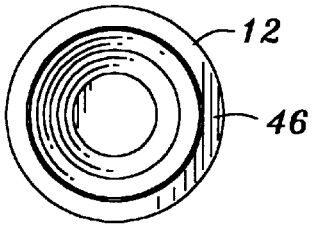
FIG. 34 is a bottom view of the cylinder of FIG. 32.

FIGS. 17–19 depict a fifth embodiment of the present invention. According to this fifth embodiment, a reduced diameter grip 64, such as the grip of the third embodiment, is added to a cylinder 12 having a flat or domed upper end 30, as described in connection with the fourth embodiment of the present invention. This embodiment is therefore something of a cross between the third and fourth embodiments.

FIGS. 20–23 depict a sixth embodiment of the present invention. According to this embodiment, a channel 50 through the cylinder 12 forms the grip 52. However, the handle 32 of the first and second embodiment is replaced by a handle 70 that has an inverted "U" shape. This same style of handle 70 is used in a seventh embodiment of the present invention, as depicted in FIGS. 24–27. According to this seventh embodiment, a reduced diameter grip 64 is formed in the center section of the cylinder 12, similar to the grip of the third and fifth embodiments, see FIGS. 9–12 and 17–19.

FIGS. 28–31 and FIGS. 32–34 depict eighth and ninth, respectively, embodiments of the present invention. In the eighth embodiment, a grip 52 is formed by a channel 50 in the center section 48 of the cylinder 12. In the ninth embodiment, a reduced diameter grip 64 is formed in the center section of the cylinder. In both of these embodiments, a handle 74 is formed at the upper end 30 of the cylinder 12. This handle 74 has a reduced diameter proximate portion 76 and an expanded diameter distal end 78 at the top of the cylinder. As with the reduced diameter grip 64, protruding rings 80 are formed into the handle 74 to provide increased strength, reduced slippage, and aesthetic appeal. This type of handle 74 may be called a "baseball bat" style handle.

It will be obvious to those of skill in the art that the various handles depicted in the FIGURES may be mixed and matched with the various grips to produce different embodiments of the present invention. Thus, the present invention has several advantages over the prior art without sacrificing any of the advantages of the prior art. Although one embodiment of the invention has been illustrated and described, various modifications and changes may be made by those skilled in the art without departing from the spirit and scope of the invention.

We claim:

1. A traffic delineator having a cylinder with a predetermined height and circumference and comprising an upper end, a lower end that flares into an outwardly extending flange, and a handle formed into the cylinder at a predetermined longitudinal position substantially at the center of gravity of the delineator when the delineator includes a base mounted on the outwardly extending flange, the handle comprising opposing angled interior walls that each form a vertex, said walls passing through the cylinder such that the vertex of each wall is generally directed towards the opposing vertex to facilitate gripping by a human hand.

2. The delineator of claim 1 further comprising an upper handle formed proximate the upper end.

3. The delineator of claim 1 wherein the handle forms a channel formed across the diameter of the cylinder.

4. The cylinder of claim 1 further comprising means for mounting a traffic warning light thereon.

5. A traffic delineator including a blow-molded integral unitary cylinder having a predetermined height, diameter and circumference, the cylinder comprising:

an upper end having a first handle formed therein;

a lower end that flares into an outwardly extending flange, the flange having a circumference greater than the circumference of the cylinder; and a central section connecting the upper end and the lower end and having a second handle formed into the cylinder at a predetermined longitudinal position that is substantially at the center of gravity of the delineator when the delineator includes a base of a predetermined size mounted on the outwardly extending flange, said second handle comprising opposing angled interior walls that each form a vertex, said walls passing through the cylinder such that the vertex of each wall is generally directed towards the opposing vertex to facilitate gripping by a human hand.

6. The traffic delineator of claim 5, including the base, wherein the base has a generally planar bottom surface adapted to rest on a road surface and forms a central circular opening in a direction perpendicular to the base surface.

7. The traffic delineator of claim 6 further comprising means for adding ballast to the base.

8. The traffic delineator of claim 5 wherein the second handle comprises a channel formed across the diameter of the cylinder.

9. The traffic delineator of claim 5 further comprising means for mounting a traffic warning light.

10. A traffic delineator adapted to be placed on a road surface by a human hand, comprising:

a base having a generally planar bottom surface adapted to rest on the road surface and forming a central circular opening with a predetermined diameter in a direction perpendicular to the base surface; and a blow-molded integral unitary cylinder having a predetermined height and circumference detachably disposed in the circular opening in the base and extending upwardly from the base, the cylinder having an exterior surface with a diameter less than the diameter of the circular opening in the base, the cylinder including:

an upper end having a handle formed therein and including means for mounting a traffic warning light thereon, the handle being sized so that it may pass through the circular opening in the base, the upper end comprising a means for mounting retroreflective sheeting thereon;

a lower end that flares into an outwardly extending flange, the flange having a radial diameter greater than the diameter of the circular opening in the base and engaging the base surface so that the cylinder is supported in an upright position by said base when the traffic delineator is placed on the road surface; and a central section connecting the upper end and the lower end and having a second handle formed into the cylinder at a predetermined longitudinal position that is substantially at the center of gravity of the delineator when the base is dropped down over the cylinder, the second handle comprising opposing angled interior walls that each form a vertex, said walls passing through the cylinder such that the vertex of each wall is generally directed towards the opposing vertex to facilitate gripping by a human hand.

11. The traffic delineator of claim 10 wherein the second handle comprises a pair of opposing cavities formed in the exterior surface of the cylinder.

12. The traffic delineator of claim 10 further comprising means for adding ballast to the base.

* * * * *